US011421351B2

(12) United States Patent
Luo et al.

(10) Patent No.: US 11,421,351 B2
(45) Date of Patent: Aug. 23, 2022

(54) CUT-RESISTANT COMPOSITE YARN STRUCTURE

(71) Applicant: HONEYWELL INTERNATIONAL INC., Charlotte, NC (US)

(72) Inventors: Rui Luo, Shanghai (CN); Jing Xu, Shanghai (CN)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 0 days.

(21) Appl. No.: 16/955,180

(22) PCT Filed: Jan. 4, 2018

(86) PCT No.: PCT/CN2018/071347

§ 371 (c)(1),
(2) Date: Jun. 18, 2020

(87) PCT Pub. No.: WO2019/134090

PCT Pub. Date: Jul. 11, 2019

(65) Prior Publication Data

US 2020/0325604 A1 Oct. 15, 2020

(51) Int. Cl.
*D02G 3/38* (2006.01)
*D02G 3/44* (2006.01)

(52) U.S. Cl.
CPC ..... *D02G 3/442* (2013.01); *D02G 3/38* (2013.01); *D10B 2501/041* (2013.01)

(58) Field of Classification Search
None
See application file for complete search history.

(56) References Cited

U.S. PATENT DOCUMENTS 5,597,649 A 1/1997 Sandor et al.
5,632,137 A 5/1997 Kolmes et al.
(Continued)

FOREIGN PATENT DOCUMENTS

CN 1148874 A 4/1997
CN 102292484 A 12/2011
(Continued)

OTHER PUBLICATIONS

International Search Report of the International Searching Authority for PCT/CN2018/071347 with dated Sep. 20, 2018.
(Continued)

*Primary Examiner* — Shawn Mckinnon
(74) *Attorney, Agent, or Firm* — Alston & Bird LLP

(57) ABSTRACT

The cut-resistant yarn structure (130,170) comprises a core-spun yarn (135) comprising a first cut-resistant core filament (132) and staple fibers (134) spun over the first cut-resistant core filament (132), a covering yarn (139) comprising a second cut-resistant core filament (136) and a first covering layer (138) wound over the second cut-resistant core filament (136), where the first covering layer (138) comprises a first filament and a second covering layer (140) wound over the core-spun yarn (135) and the covering yarn (139), where the second covering layer (140) comprises a second filament. The cut-resistant composite yarn structure can be used to manufacture cut-resistant cloth which may in turn be used to manufacture cut-resistant garments such as cut-resistant gloves, cut-resistant sleeves and other cut-resistant garments.

20 Claims, 4 Drawing Sheets

(56) References Cited

U.S. PATENT DOCUMENTS

| | | | | |
|---|---|---|---|---|
| 5,806,295 | A | 9/1998 | Robins et al. | |
| 2003/0074879 | A1 | 4/2003 | Patrick | |
| 2005/0022494 | A1 | 2/2005 | Piat | |
| 2005/0025950 | A1 | 2/2005 | Hanyon et al. | |
| 2014/0000750 | A1 | 1/2014 | Carrara et al. | |
| 2014/0090349 | A1* | 4/2014 | Fisher | D02G 3/12 57/222 |
| 2015/0181956 | A1 | 7/2015 | Andrews et al. | |
| 2015/0220146 | A1* | 8/2015 | Fisher | G06F 3/014 2/167 |

FOREIGN PATENT DOCUMENTS

| | | | |
|---|---|---|---|
| CN | 104452007 | A | 3/2015 |
| CN | 105274692 | A | 1/2016 |
| CN | 106192120 | A | 12/2016 |
| GB | 2018323 | A | 10/1979 |
| JP | S63-196727 | A | 8/1988 |
| KR | 1660027 | B1 | 9/2016 |
| WO | 2004/042123 | A2 | 5/2004 |

OTHER PUBLICATIONS

Written Opinion for International Patent Application No. PCT/CN2018/071347 dated Sep. 20, 2018, 4 pages.
European Search Report and Search Opinion Received for EP Application No. 18898945.3, dated Jul. 5, 2021, 5 pages.
Communication about intention to grant a European patent received for EP Application No. 18898945.3, dated Jan. 4, 2022, 6 pages.
CN Office Action, including Search Report, dated Jan. 4, 2022 for CN Application No. 201811548363.
English Translation of CN Office Action dated Jan. 4, 2022 for CN Application No. 201811548363.
Extended European Search Report for Application No. 19215443.3 dated May 29, 2020, 9 pages.
Non-Final Office Action received for U.S. Appl. No. 16/714,929, dated Dec. 1, 2021, 8 pages.
Corrected Notice of Allowability received for U.S. Appl. No. 16/714,929, dated May 11, 2022, 4 pages.
Decision to grant a European patent received for European Application No. 18898945.3, dated May 12, 2022, 2 pages.*.
Notice of Allowance received for U.S. Appl. No. 16/714,929, dated Apr. 20, 2022, 7 pages.

* cited by examiner

CUT-RESISTANT COMPOSITE YARN STRUCTURE

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Yarns may be manufactured by combining separate threads of filaments, for example by winding one thread or filament on top of one or more other threads or filaments. The yarn may be formed by twisting the one or more threads or filaments around each other. A composite yarn may be composed of a plurality of other yarns. Yarns may be interlocked or woven to create continuous cloths. Different knitting structures may be formed as a jersey knit structure, a plating knit structure, a rib knit structure, or other knit structure. Yarn-based cloths may be used to make garments such as gloves, sleeves, shirts, pants, socks, coverings, and other cloths.

SUMMARY

In an embodiment, a cut-resistant composite yarn structure is disclosed. The cut-resistant composite yarn comprises a core-spun yarn comprising a first cut-resistant core filament and staple fibers spun over the first cut-resistant core filament, a covering yarn comprising a second cut-resistant core filament and a first covering layer wound over the second cut-resistant core filament, where the first covering layer comprises a first filament, and a second covering layer wound over the core-spun yarn and the covering yarn, where the second covering layer comprises a second filament.

In an embodiment, a method of manufacturing a cut-resistant composite yarn structure is disclosed. The method comprises spinning staple fibers over a first cut-resistant core filament to build a core-spun yarn, winding a first filament over a second cut-resistant filament to build a covering yarn, and winding a second filament over the core-spun yarn and the covering yarn to bind the core-spun yarn with the covering yarn, thereby forming the cut-resistant composite yarn structure.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The following brief definition of terms shall apply throughout the application:

The term "comprising" means including but not limited to, and should be interpreted in the manner it is typically used in the patent context;

The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the specification describes something as "exemplary" or an "example," it should be understood that refers to a non-exclusive example;

The terms "about" or "approximately" or the like, when used with a number, may mean that specific number, or alternatively, a range in proximity to the specific number, as understood by persons of skill in the art field; and If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

Embodiments of the disclosure include cut-resistant yarns and cut-resistant cloth. Standards for cut resistance may be defined and enforced by standards bodies or government agencies. From time to time these standards may be revised to raise the standard in order to reduce injuries or other accidents, for example in response to analysis of accident statistics and/or in response to improved technologies. The cut-resistant yarns described herein are comprised of a combination of different techniques for achieving increased resistance to cutting. The use of a combination of techniques rather than simply using one technique may promote achieving a plurality of at least partly antagonistic objectives and/or to balance the properties of a given design.

Figure 1:
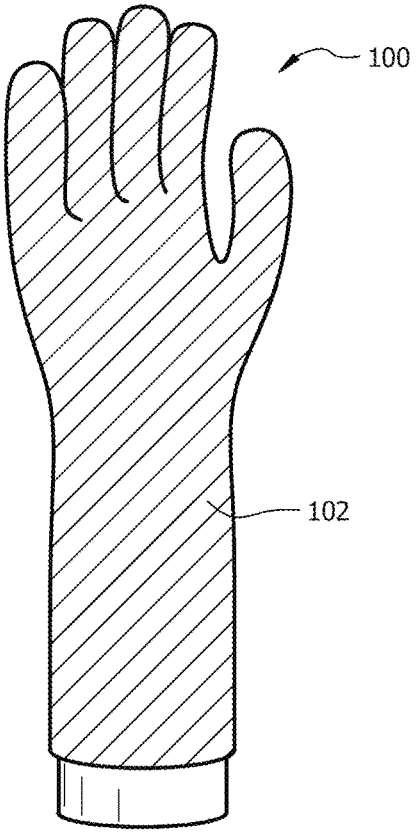
FIG. 1 illustrates a cut-resistant glove according to an embodiment of the disclosure.

Referring now to FIG. 1, a cut-resistant glove 100 is described. The cut-resistant glove 100 may be manufactured from a cut-resistant cloth 102. The cut-resistant cloth can be made using cut-resistant yarns described further hereinafter.

Figure 2:
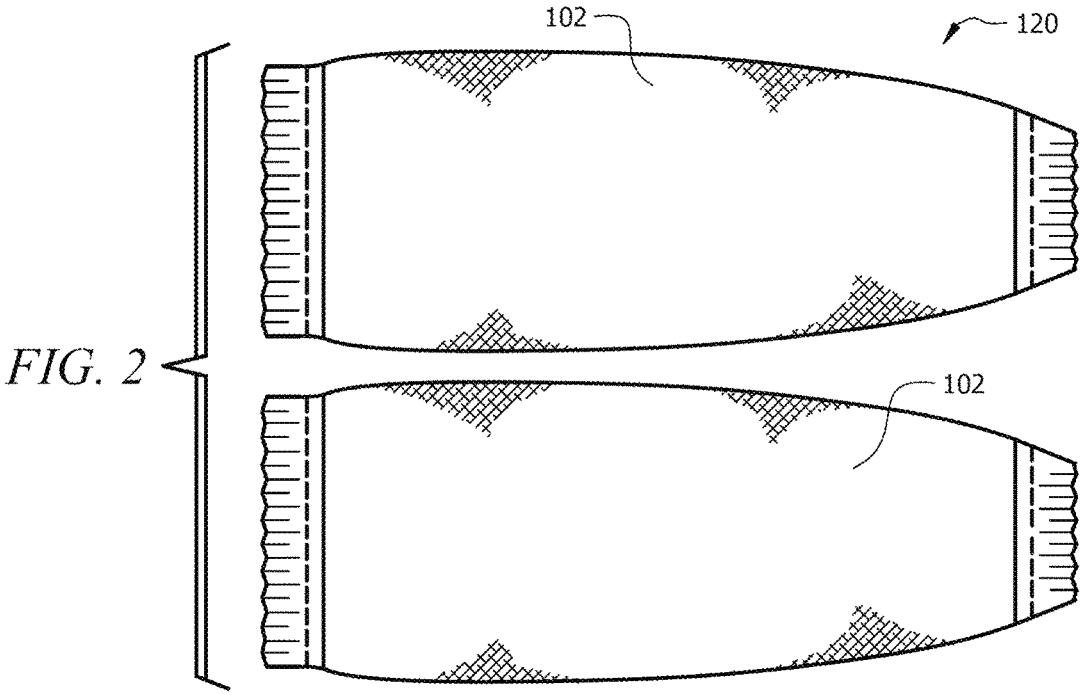
FIG. 2 illustrates a pair of cut-resistant sleeves according to an embodiment of the disclosure.

Referring now to FIG. 2, a pair of cut-resistant sleeves 120 is described. The cut resistant sleeves 120 may be manufactured from the cut-resistant cloth 102. The cut-resistant cloth 102 can be made using cut-resistant yarns described further hereinafter. It will be appreciated that while a cut-resistant glove 100 and cut-resistant sleeves 120 have been illustrated and described above, the teachings of this patent application about how to make cut-resistant cloth from a cut-resistant yarn disclosed herein can be applied to other garments and articles that are desirably cut-resistant and formed from cut-resistant cloth made from the cut-resistant yarn disclosed herein.

Figure 3A:
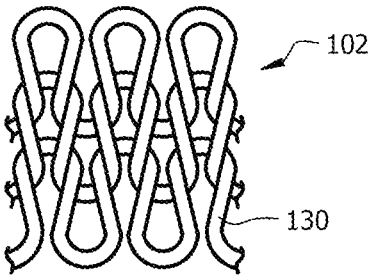
FIG. 3A and FIG. 3B illustrate a knitting pattern according to an embodiment of the disclosure.
Figure 3B:
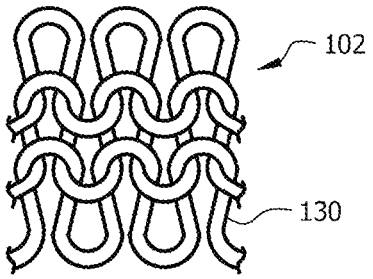

Referring now to FIG. 3A and FIG. 3B, the cut-resistant cloth 102 is described further. The cut-resistant cloth 102 may be manufactured in any suitable way. The cut-resistant cloth 102 may be woven, knitted, or felted. In some contexts, the cut-resistant cloth 102 may be referred to as a cut-resistant fabric or as a cut-resistant textile. In an embodiment, the cut-resistant cloth 102 is formed, at least in part, from a first cut-resistant composite yarn structure 130. As illustrated in FIG. 3A and FIG. 3B, the cut-resistant cloth 102 may be a knitted cloth. FIG. 3A shows a front side of the cut-resistant cloth 102, and FIG. 3B shows a back side of the cut-resistant cloth 102. It is understood that the cut-resistant cloth can be formed with different kinds of knitting techniques. The cut-resistant cloth can be formed using non-knitting techniques, such as using weaving or felting techniques.

Figure 4:
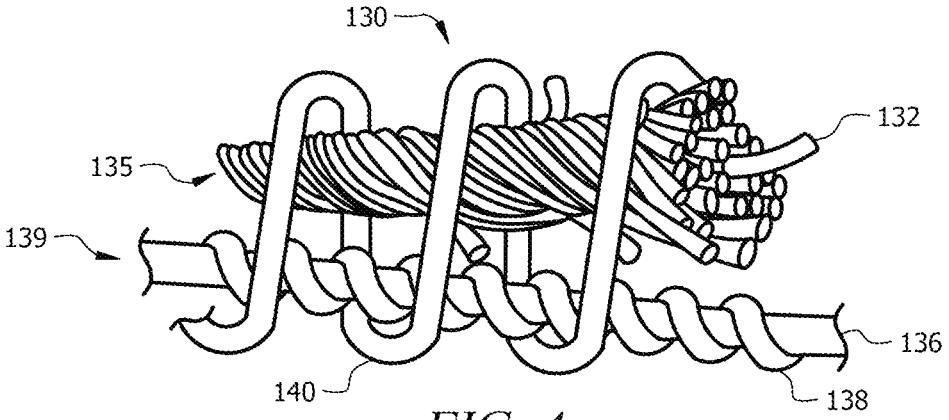
FIG. 4 illustrates a cut-resistant composite yarn structure according to an embodiment of the disclosure.

Turning now to FIG. 4, details of an embodiment of the first cut-resistant composite yarn structure 130 are described. In an embodiment, the first cut-resistant composite yarn structure 130 is formed from a core-spun yarn 135, a covering yarn 139, and a covering layer 140 wound over the core-spun yarn 135 and the covering yarn 139. Further details of the core-spun yarn 135 and of the covering yarn 139 are described hereinafter. The core-spun yarn 135 and the covering yarn 139 may be laid out straight (i.e., not wound about each other, not twisted about each other) and then secured together by the covering layer 140 that winds around the yarns 135, 139 to form the first cut-resistant composite yarn structure 130. Alternatively, in an embodiment, the first cut-resistant composite yarn structure 130 may be formed by wrapping one of the yarns 135, 139 about the other yarn, and then winding the covering layer 140 about the combination of yarns 135, 139. Alternatively, in an embodiment, the yarns 135, 139 are both twisted about each other, and then the covering layer 140 is wound about the combination of yarns 135, 139.

Figure 5:
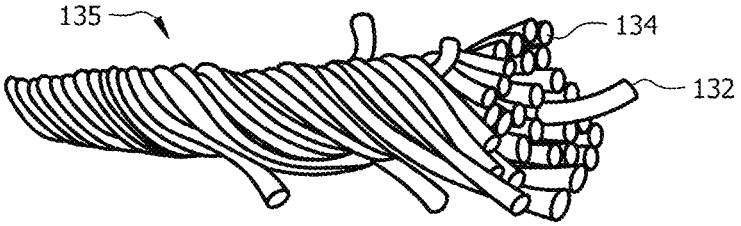
FIG. 5 illustrates a cut-resistant core-spun yarn structure according to an embodiment of the disclosure.

Turning now to FIG. 5, further details of the core-spun yarn 135 are described. In an embodiment, the core-spun yarn 135 is composed of a first cut-resistant core filament 132 and a plurality of staple fibers 134 spun over the first cut-resistant core filament 132. The staple fibers 134 may be fibers that are inherently relatively short or may be formed by cutting long fibers into shorter, staple-length fibers. In an embodiment, the staple fibers 134 comprise polyester, PE series-polyester, polyethylene, high performance polyethylene (HPPE), high molecular weight polyethylene (HMWPE), regenerated cellulose, fire retardant regenerated cellulose, polyimide, para-aramid, or polyacrylonitrile (PAN), or a combination thereof.

In an embodiment, the first cut-resistant core filament 132 may comprise basalt material, steel material, steel alloy material, or a combination thereof. In another embodiment, however, the first cut-resistant core filament 132 may comprise different material not including basalt, steel, or steel alloy material. As is understood by those of skill in the art, basalt filaments or basalt fibers may be manufactured from crushed basalt, melting the crushed basalt, and extruding the molten basalt through nozzles to produce continuous filaments of basalt fiber. It will be appreciated that the basalt filaments or basalt fibers may have a relatively small admixture of other substances or materials and yet retain the desired cut-resistant properties. In an embodiment, the core-spun yarn 135 comprises two or more first cut-resistant core filaments 132.

Figure 6:
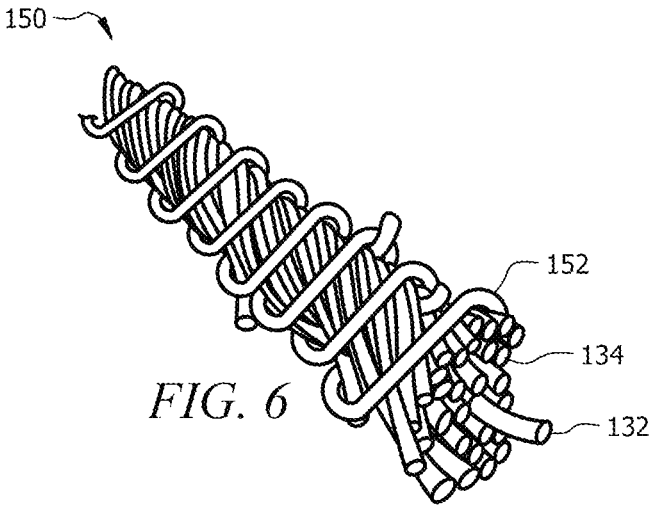
FIG. 6 illustrates another cut-resistant core-spun yarn structure according to an embodiment of the disclosure.

Turning now to FIG. 6, a second core-spun yarn 150 is described. In an embodiment, the second core-spun yarn 150 is substantially similar to core-spun yarn 135 described with reference to FIG. 5, with the addition of a second covering layer 152 wound over the combination of the first cut-resistant core filament 132 and the staple fibers 134. The second covering layer 152 may comprise polyester, PE series-polyester, polyethylene, high performance polyethylene (HPPE), high molecular weight polyethylene (HMWPE), regenerated cellulose, fire retardant regenerated cellulose, polyimide, para-aramid, or polyacrylonitrile (PAN), or a combination thereof. In some embodiments of the cut-resistant composite yarn, the second core-spun yarn 150 may be combined with the covering yarn 139 and wrapped with the covering layer 140 to form the cut-resistant composite yarn. In an embodiment, the second core-spun yarn 150 comprises two or more first cut-resistant core filaments 132.

Figure 7:
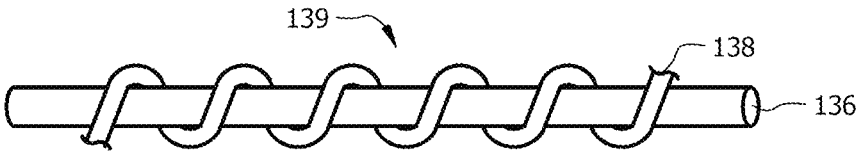
FIG. 7 illustrates a cut-resistant covering yarn structure according to an embodiment of the disclosure.

Turning now to FIG. 7, further details of the covering yarn 139 are described. In an embodiment, the covering yarn 139 comprises a second cut-resistant core filament 136 and a third covering layer 138. The third covering layer 138 may comprise polyester, PE series-polyester, polyethylene, high performance polyethylene (HPPE), high molecular weight polyethylene (HMWPE), regenerated cellulose, fire retardant regenerated cellulose, polyimide, para-aramid, or polyacrylonitrile (PAN), or a combination thereof. The second cut-resistant core filament 136 may comprise basalt material, steel material, steel alloy material, or a combination thereof. In another embodiment, however, the second cut-resistant core filament 136 may comprise different material not including basalt, steel, or steel alloy material. The third covering layer 138 may be wrapped around the second cut-resistant core filament 136. In an embodiment, the covering yarn 139 may comprise two or more second cut-resistant core filaments 136.

Figure 8:
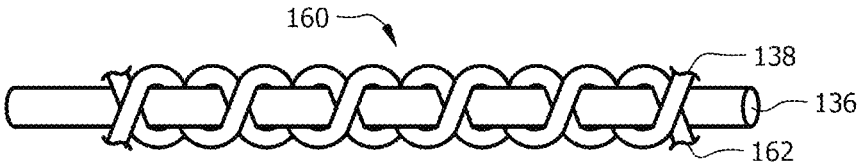
FIG. 8 illustrates another cut-resistant covering yarn structure according to an embodiment of the disclosure.

Turning now to FIG. 8, a second covering yarn 160 is described. The second covering yarn is substantially similar to the covering yarn 139 described above with reference to FIG. 7, with the addition of a fourth covering layer 162 wrapped around the second cut-resistant core filament 136. The fourth covering layer 162 and the third covering layer 138 may be wound in opposite senses. The fourth covering layer 162 and the third covering layer 138 may be wound at the same time over the second cut-resistant core filament 136, where the covering layers 138, 162 may be interwound. Alternatively, the third covering layer 138 may be wound first and the fourth covering layer 162 wound second and over the third covering layer 138. The fourth covering layer 162 may comprise polyester, PE series-polyester, polyethylene, high performance polyethylene (HPPE), high molecular weight polyethylene (HMWPE), regenerated cellulose, fire retardant regenerated cellulose, polyimide, para-aramid, or polyacrylonitrile (PAN), or a combination thereof. The material that is used to make the third covering layer 138 may be different from the material used to make the fourth covering layer 162 or the covering layers 138, 162 may be made from the same material. In an embodiment, the second covering yarn 160 may comprise two or more second cut-resistant core filaments 136.

Figure 9:
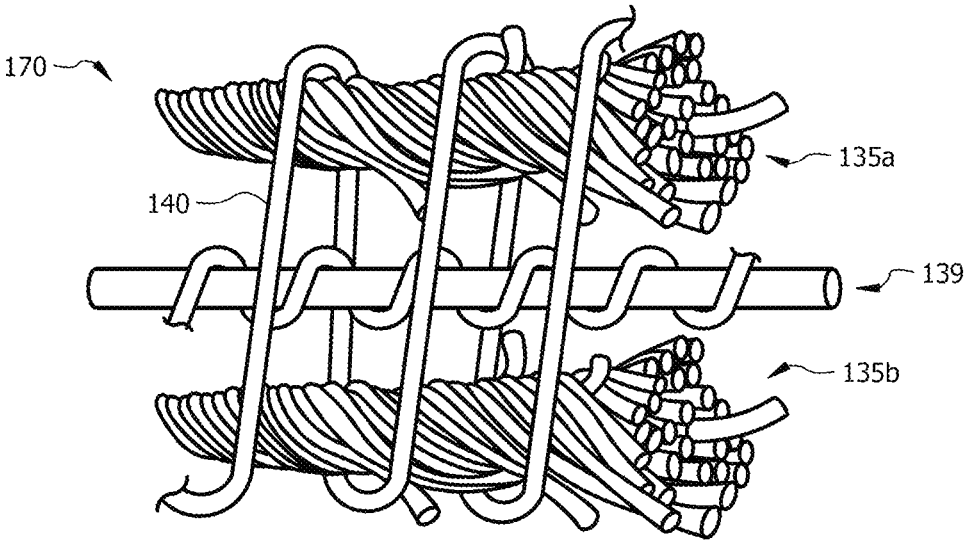
FIG. 9 illustrates another cut-resistant composite yarn structure according to an embodiment of the disclosure.

Turning now to FIG. 9, a second cut-resistant composite yarn structure 170 is described. The second cut-resistant composite yarn structure 170 is substantially similar to the first cut-resistant composite yarn structure 130, with the provision that the second cut-resistant composite yarn structure 170 comprises two core-spun yarns 135, a core-spun yarn 135*a* and a core-spun yarn 135*b*. It will be appreciated the present disclosure contemplates other cut-resistant yarn structures composed of one or more core-spun yarns 135, 150 and one or more covering yarns 139, 160 wrapped with the covering layer 140.

Having described various devices and methods herein, exemplary embodiments or aspects can include, but are not limited to:

In a first embodiment, a cut-resistant composite yarn structure can comprise a core-spun yarn comprising a first cut-resistant core filament and staple fibers spun over the first cut-resistant core filament, a covering yarn comprising a second cut-resistant core filament and a first covering layer wound over the second cut-resistant core filament, where the first covering layer comprises a first filament, and a second covering layer wound over the core-spun yarn and the covering yarn, where the second covering layer comprises a second filament.

A second embodiment can include the cut-resistant composite yarn of the first embodiment, wherein the first cut-resistant core filament comprises one of basalt material, steel material, or a steel alloy material.

A third embodiment can include the cut-resistant composite yarn of the first embodiment, wherein the second cut-resistant core filament comprises one of basalt material, steel material, or a steel alloy material.

A fourth embodiment can include the cut-resistant composite yarn of the first embodiment, wherein the second filament comprises at least one of polyester, PE series-polyester, polyethylene, high performance polyethylene (HPPE), high molecular weight polyethylene (HMWPE), or regenerated cellulose.

A fifth embodiment can include the cut-resistant composite yarn of the first embodiment, wherein the second filament comprises at least one of fire retardant regenerated cellulose, polyimide, para-aramid, or polyacrylonitrile (PAN).

A sixth embodiment can include the cut-resistant composite yarn of the first embodiment, wherein the staple fibers comprise at least one of polyester, PE series-polyester, polyethylene, high performance polyethylene (HPPE), high molecular weight polyethylene (HMWPE), or regenerated cellulose.

A seventh embodiment can include the cut-resistant composite yarn of the first embodiment, wherein the staple fibers comprise at least one of fire retardant regenerated cellulose, polyimide, para-aramid, or polyacrylonitrile (PAN).

An eighth embodiment can include the cut-resistant composite yarn of the first embodiment, further comprising a second core-spun yarn comprising a third cut-resistant core filament and staple fibers spun over the third cut-resistant core, wherein the second cover layer is further wound over the second core-spun yarn.

A ninth embodiment can include the cut-resistant composite yarn of the first embodiment, further comprising a second covering yarn comprising a third cut-resistant core filament and a third covering layer wound over the third cut-resistant filament, where the third covering layer comprises a third filament, wherein the second covering layer is further wound over the second covering yarn.

In a tenth embodiment, a method of manufacturing a cut-resistant composite yarn structure can comprise spinning staple fibers over a first cut-resistant core filament to build a core-spun yarn, winding a first filament over a second cut-resistant filament to build a covering yarn, and winding a second filament over the core-spun yarn and the covering yarn to bind the core-spun yarn with the covering yarn, thereby forming the cut-resistant composite yarn structure.

An eleventh embodiment can include the method of the tenth embodiment, wherein the first cut-resistant core filament comprises one of basalt material, steel material, or a steel alloy material.

A twelfth embodiment can include the method of the tenth embodiment, wherein the second cut-resistant core filament comprises one of basalt material, steel material, or a steel alloy material.

A thirteenth embodiment can include the method of the tenth embodiment, wherein the second filament comprises at least one of polyester, PE series-polyester, polyethylene, high performance polyethylene (HPPE), high molecular weight polyethylene (HMWPE), or regenerated cellulose.

A fourteenth embodiment can include the method of the tenth embodiment, wherein the second filament comprises at least one of fire retardant regenerated cellulose, polyimide, para-aramid, or polyacrylonitrile (PAN).

A fifteenth embodiment can include the method of the tenth embodiment, further comprising spinning staple fibers over a third cut-resistant core filament to build a second core-spun yarn, wherein winding the second filament comprises winding the second filament over the core-spun yarn, the second core spun yarn, and the covering yarn.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow that scope including all equivalents of the subject matter of the claims. Each and every claim is incorporated as further disclosure into the specification and the claims are embodiment(s) of the present invention(s). Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Use of broader terms such as "comprises," "includes," and "having" should be understood to provide support for narrower terms such as "consisting of," "consisting essentially of," and "comprised substantially of." Use of the terms "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A cut-resistant composite yarn structure, comprising:

a core-spun yarn comprising a first cut-resistant core filament and staple fibers spun over the first cut-resistant core filament;

a covering yarn comprising a second cut-resistant core filament and a first covering layer wound over the second cut-resistant core filament, where the first covering layer comprises a first filament; and a second covering layer wound over the core-spun yarn and the covering yarn, where the second covering layer comprises a second filament.

2. The cut-resistant composite yarn structure of claim 1, wherein the first cut-resistant core filament comprises one of basalt material, steel material, or a steel alloy material.

3. The cut-resistant composite yarn structure of claim 1, wherein the second cut-resistant core filament comprises one of basalt material, steel material, or a steel alloy material.

4. The cut-resistant composite yarn structure of claim 1, wherein the second filament comprises at least one of polyester, PE series-polyester, polyethylene, high performance polyethylene (HPPE), high molecular weight polyethylene (HMWPE), or regenerated cellulose.

5. The cut-resistant composite yarn structure of claim 1, wherein the second filament comprises at least one of fire retardant regenerated cellulose, polyimide, para-aramid, or polyacrylonitrile (PAN).

6. The cut-resistant composite yarn structure of claim 1, wherein the staple fibers comprise at least one of polyester, PE series-polyester, polyethylene, high performance polyethylene (HPPE), high molecular weight polyethylene (HMWPE), or regenerated cellulose.

7. The cut-resistant composite yarn structure of claim 1, wherein the staple fibers comprise at least one of fire retardant regenerated cellulose, polyimide, para-aramid, or polyacrylonitrile (PAN).

8. The cut-resistant composite yarn structure of claim 1, further comprising a second core-spun yarn comprising a third cut-resistant core filament and staple fibers spun over the third cut-resistant core filament, wherein the second covering layer is further wound over the second core-spun yarn.

9. The cut-resistant composite yarn structure of claim 8, further comprising a second covering yarn comprising a fourth cut-resistant core filament and a third covering layer wound over the third cut-resistant core filament, where the third covering layer comprises a third filament, wherein the second covering layer is further wound over the second covering yarn.

10. A method of manufacturing a cut-resistant composite yarn structure, comprising:

spinning staple fibers over a first cut-resistant core filament to build a core-spun yarn, winding a first covering layer over a second cut-resistant core filament to build a covering yarn; and winding a second covering layer over the core-spun yarn and the covering yarn to bind the core-spun yarn with the covering yarn, thereby forming the cut-resistant composite yarn structure.

11. The method of claim 10, wherein the first cut-resistant core filament comprises one of basalt material, steel material, or a steel alloy material.

12. The method of claim 11, wherein the second cut-resistant core filament comprises one of basalt material, steel material, or a steel alloy material.

13. The method of claim 10, wherein the second covering layer comprises at least one of polyester, PE series-polyester, polyethylene, high performance polyethylene (HPPE), high molecular weight polyethylene (HMWPE), or regenerated cellulose.

14. The method of claim 10, wherein the second covering layer comprises at least one of fire retardant regenerated cellulose, polyimide, para-aramid, or polyacrylonitrile (PAN).

15. The method of claim 10, further comprising spinning staple fibers over a third cut-resistant core filament to build a second core-spun yarn, wherein winding the second covering layer comprises winding the second covering layer over the core-spun yarn, the second core spun yarn, and the covering yarn.

16. A cut-resistant composite yarn structure, comprising:

a first core-spun yarn comprising a first cut-resistant core filament and first staple fibers spun over the first cut-resistant core filament;

a covering yarn comprising a second cut-resistant core filament and a first covering layer wound over the second cut-resistant core filament, where the first covering layer comprises a first filament;

a second core-spun yarn comprising a third cut-resistant core filament and second staple fibers spun over the third cut-resistant core filament; and a second covering layer wound over the first core-spun yarn, the second core-spun yarn, and the covering yarn, where the second covering layer comprises a second filament.

17. The cut-resistant composite yarn structure of claim 16, wherein the first cut-resistant core filament comprises one of basalt material, steel material, or a steel alloy material.

18. The cut-resistant composite yarn structure of claim 16, wherein the second cut-resistant core filament comprises one of basalt material, steel material, or a steel alloy material.

19. The cut-resistant composite yarn structure of claim 16, wherein the third cut-resistant core filament comprises one of basalt material, steel material, or a steel alloy material.

20. The cut-resistant composite yarn structure of claim 16, wherein the second filament comprises at least one of fire retardant regenerated cellulose, polyimide, para-aramid, or polyacrylonitrile (PAN).

* * * * *